US007616924B2

(12) United States Patent
Uchiyama et al.

(10) Patent No.: US 7,616,924 B2
(45) Date of Patent: Nov. 10, 2009

(54) SHEET POST-PROCESSING AND IMAGE FORMING SYSTEM WITH A SHEET-TRIMMING APPARATUS CONTAINING A BLADE AND BLADE-RECEIVING MEMBER DRIVING MECHANISMS

(75) Inventors: Masaaki Uchiyama, Hachioji (JP); Toshio Shida, Higashiyamato (JP); Hiroyuki Wakabayashi, Hachioji (JP); Masato Hattori, Hino (JP); Kenji Kawatsu, Machida (JP)

(73) Assignee: Konica Minolta Business Technologies, Inc. (JP)

( * ) Notice: Subject to any disclaimer, the term of this patent is extended or adjusted under 35 U.S.C. 154(b) by 342 days.

(21) Appl. No.: 11/042,982

(22) Filed: Jan. 25, 2005

(65) Prior Publication Data

US 2006/0011040 A1 Jan. 19, 2006

(30) Foreign Application Priority Data

Jul. 16, 2004 (JP) ..... 2004-210271

(51) Int. Cl.
*G03G 15/00* (2006.01)

(52) U.S. Cl. ..... 399/407; 399/408

(58) Field of Classification Search ..... 399/407, 399/408, 410, 385, 374, 125; 83/934
See application file for complete search history.

(56) References Cited

U.S. PATENT DOCUMENTS

| | | | | |
|---|---|---|---|---|
| 5,163,349 | A * | 11/1992 | Takagi et al. | 83/386 |
| 2002/0021924 | A1 * | 2/2002 | Mimura et al. | 399/407 |
| 2004/0096253 | A1 | 5/2004 | Ueno et al. | |

FOREIGN PATENT DOCUMENTS

| | | | |
|---|---|---|---|
| JP | 2000211806 | A * | 8/2000 |
| JP | 2001-240296 | | 9/2001 |
| JP | 2003136471 | A * | 5/2003 |
| JP | 2003-191196 | | 7/2003 |
| JP | 2003-228205 | | 8/2003 |
| JP | 2004-114198 | | 4/2004 |
| JP | 2004114198 | A * | 4/2004 |

OTHER PUBLICATIONS

Office Action for Patent Application No. Tokugan No. 2005-002420 mailed Aug. 7, 2007.

* cited by examiner

*Primary Examiner*—Judy Nguyen
*Assistant Examiner*—Matthew G Marini
(74) *Attorney, Agent, or Firm*—Cantor Colburn LLP

(57) ABSTRACT

A sheet-trimming apparatus having a blade-driving mechanism which presses a trimming blade against the sheet in a oblique direction to the sheet surface for trimming the sheet and a receiving-member driving mechanism which shifts a blade-receiving member receiving the trimming blade in the direction cross to the direction of the trimming blade.

7 Claims, 9 Drawing Sheets

SHEET POST-PROCESSING AND IMAGE FORMING SYSTEM WITH A SHEET-TRIMMING APPARATUS CONTAINING A BLADE AND BLADE-RECEIVING MEMBER DRIVING MECHANISMS

BACKGROUND OF THE INVENTION

The present invention relates to a sheet trimming apparatus which trims plural sheets, a sheet post-processing apparatus equipped with the sheet-trimming apparatus and an image-forming system equipped with the sheet-trimming apparatus.

With a high-speed image-forming apparatus such as an electrophotograghic type image-forming apparatus connected with a sheet post-processing apparatus which carries out various kinds of post-processes, there have been popularized versatile image-forming systems which make it possible that various kinds of processes are conducted by one apparatus, such as a perforating process, a stitching process, a folding process on sheets which have been image-formed.

The various kinds of post-processing apparatuses include a sheet-trimming apparatus which evens the edge of a bundle of plural sheets and, for example, an image-forming system including a trimming apparatus which trims an edge of sheets after a center-folding process and a saddle-stitching process are carried out has been disclosed in Patent Document 1. The sheet-trimming apparatus described in Patent Document 1 is called a guillotine type one, the trimming blade of which is pressed on sheets in the direction perpendicular to the surface of sheets to trim them.

A sheet-trimming apparatus the trimming blade of which is pressed on sheets in an oblique direction has been disclosed in Patent Document 2.

Patent Document 1 Japanese Patent Application Publication No. 2003-228205

Patent Document 2 Japanese Patent Application Publication No. 2003-191196

The guillotine type trimming apparatus described in Patent Document 1 needs large force for driving the trimming blade, and besides, it needs a high power motor because the power of driving means needs to be set at the maximum value in the working range, and thus, there are caused problems that it needs a large-sized apparatus and high power consumption. Especially it is difficult to incorporate the trimming apparatus into a post-processing apparatus composing an image-forming system.

Regarding the trimming apparatus described in Patent Document 2, though a table which sustains sheets also functions as a blade-receiving member which receives the trimming blade, a part of the table is chopped off by the trimming blade during trimming operations repeated many times and a notch is formed on the table, resulting in some problems such as incomplete cut of sheets and unevenness of the trimmed edge surface caused by the notch.

SUMMARY OF THE INVENTION

An object of the invention is to solve the problems of this kind in a conventional sheet-trimming apparatus and is especially to provide a sheet-trimming apparatus used suitably as a part of image-forming system, a sheet post-processing apparatus having the sheet-trimming apparatus and an image-forming system having the sheet-trimming apparatus.

The above-mentioned objects are achieved by any one of the inventions below.

(1). A sheet-trimming apparatus comprising a trimming blade to trim sheets, a blade-driving mechanism to move the trimming blade obliquely to a surface of a sheet located in a trimming position, a blade-receiving member to receive the trimming blade in the trimming position and a receiving-member driving mechanism to shift the blade-receiving member in the direction cross to the trimming direction of the trimming blade.

(2). A sheet post-processing apparatus comprising a sheet-folding mechanism to fold sheets and the sheet-trimming apparatus of (1) which trims an edge of the sheets folded by the sheet-folding mechanism.

(3). An image-forming system comprising an image-forming apparatus to form an image on a sheet and the sheet-trimming apparatus of (1) which trims an edge of the sheet formed the image by the image-forming apparatus.

DETAILED DESCRIPTION OF THE PREFERRED EMBODIMENT

An embodiment of the invention will be explained below referring to drawings.

Figure 1:
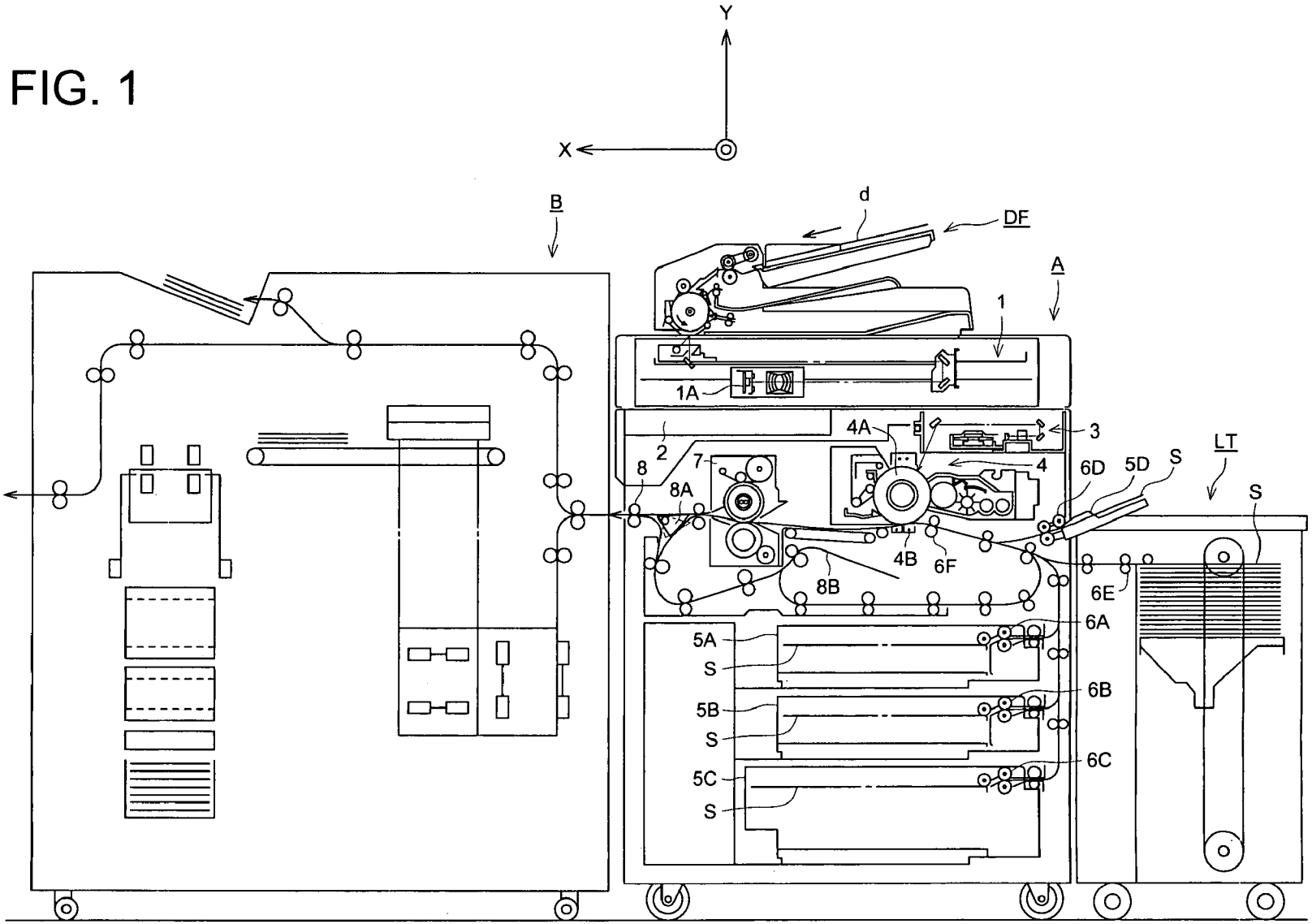
FIG. 1 is a general structural view of an image-forming system related to the embodiment of the invention.

FIG. 1 is a general structural view of an image-forming system having a trimming apparatus and a sheet post-processing apparatus of an embodiment of the invention.

Symbol A indicates an image-forming apparatus, DF indicates an automatic document feeder, LT indicates a large-capacity paper feeder and B indicates a post-processing apparatus.

The image-forming apparatus A includes image-reading portion (image input device) 1, image-processing portion 2, image-writing portion 3, image-forming portion 4, paper-feed cassettes 5A, 5B, 5C, manual paper-feed tray 5D, first paper feeders 6A, 6B, 6C, 6D, 6E, registration roller 6F, fixing unit 7, paper discharge portion 8 and automatic duplex copy paper feeder (ADU) 8B.

Automatic document feeder DF is mounted on the upper part of the image-forming apparatus A and post-processing apparatus B is connected to the image-forming apparatus solidly as shown in the left side of the diagram.

An original document d set on a document tray of automatic document feeder DF is conveyed in the direction of the arrow and an image on one side or images on both sides of the document is read by CCD image sensor 1A of an optical system in the image-reading portion 1.

Analog signals which have been photoelectrically transduced by the CCD image sensor 1A are, analog-processed, A/D converted, processed with shading correction and image-compressed in the image-processing portion 2 and then sent to the image-writing portion 3 as image information signals.

Image-forming portion 4 is a portion forming images with electrophotographic process, wherein processes such as charging, exposure, development, transfer, separation and cleaning are carried out on a photoreceptor drum 4A. Ray of light from a semiconductor laser (not illustrated) based on an image information signal is irradiated to the photoreceptor drum 4A and an electrostatic latent image is formed in the process of exposure. Besides, a toner image corresponding to the electrostatic latent image is formed in the process of development.

When one of the feeders among paper feed cassettes from 5A through 5C, manual paper feed tray 5D and large-capacity paper feeder LT is selected together with the corresponding first paper feeder among 6A through 6E, a sheet of paper S is conveyed toward registration roller 6F. The sheet of paper is synchronized with a toner image on the photoreceptor drum 4A by the registration roller 6F to be conveyed toward transfer means 4B so that the toner image is transferred on it.

The sheet of paper S carrying a toner image is fed from paper discharge portion 8 to post-processing apparatus B after the toner image is fixed by fixing unit 7.

When the automatic duplex copy is selected, a sheet of paper wherein an image is formed on one side of the sheet is fed to the automatic duplex copy paper feeder 8B by switching of conveying passage a switching plate 8A, so that another image forming is carried out on the other side of the sheet in the image-forming portion 4, and fed to the post-processing apparatus B from the paper discharge portion 8 after toner is fixed in the fixing unit 7.

Next, an explanation will be given regarding outline of the post-processing apparatus B referring to FIG. 2, FIG. 3, FIG. 4 and FIG. 5.

Figure 2:
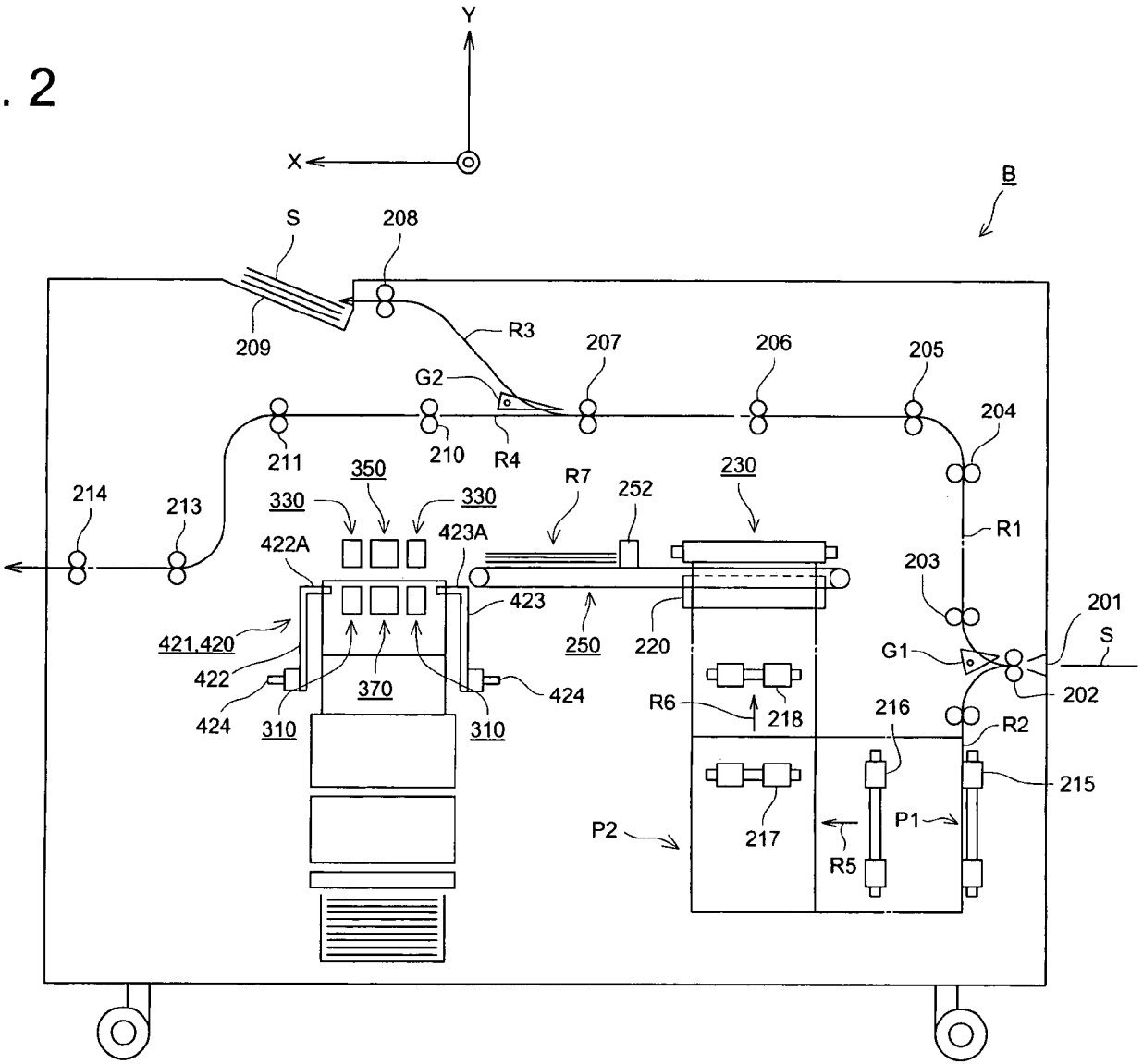
FIG. 2 is a schematic front view of a post-processing apparatus.
Figure 3:
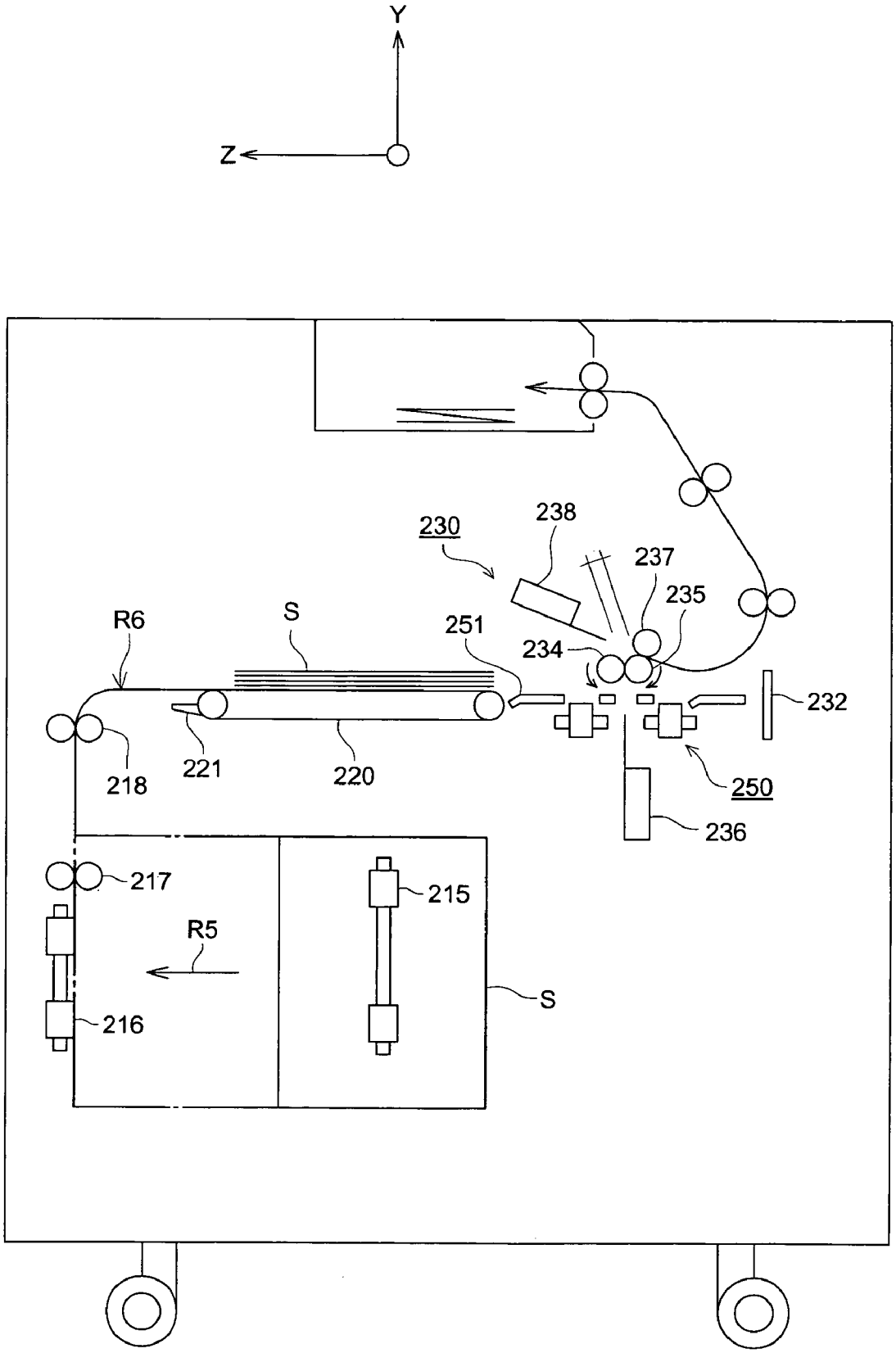
FIG. 3 is a right side view of the post-processing apparatus in FIG. 2.
Figure 4:
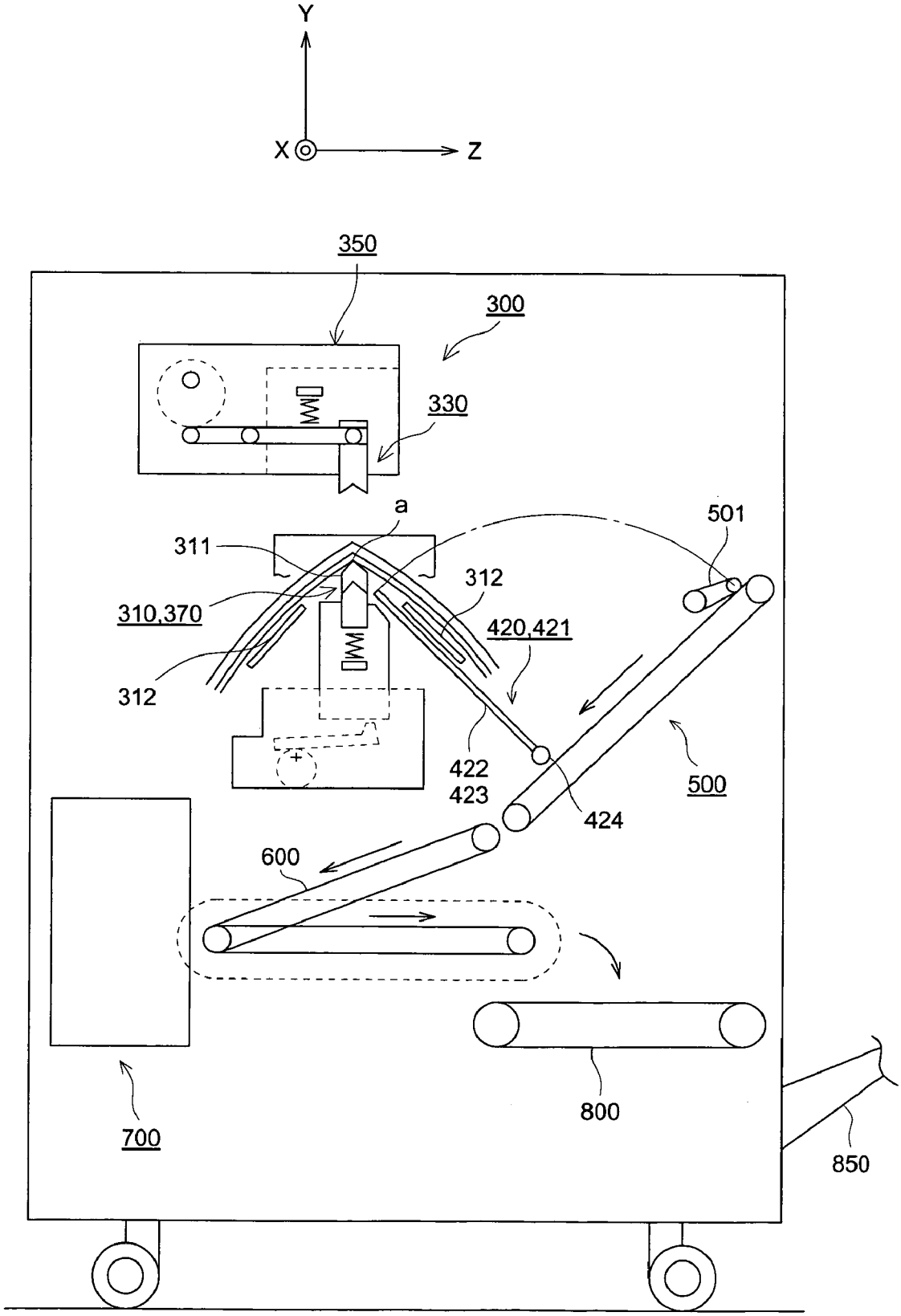
FIG. 4 is a left side view of the post-processing apparatus in FIG. 2.
Figure 5:
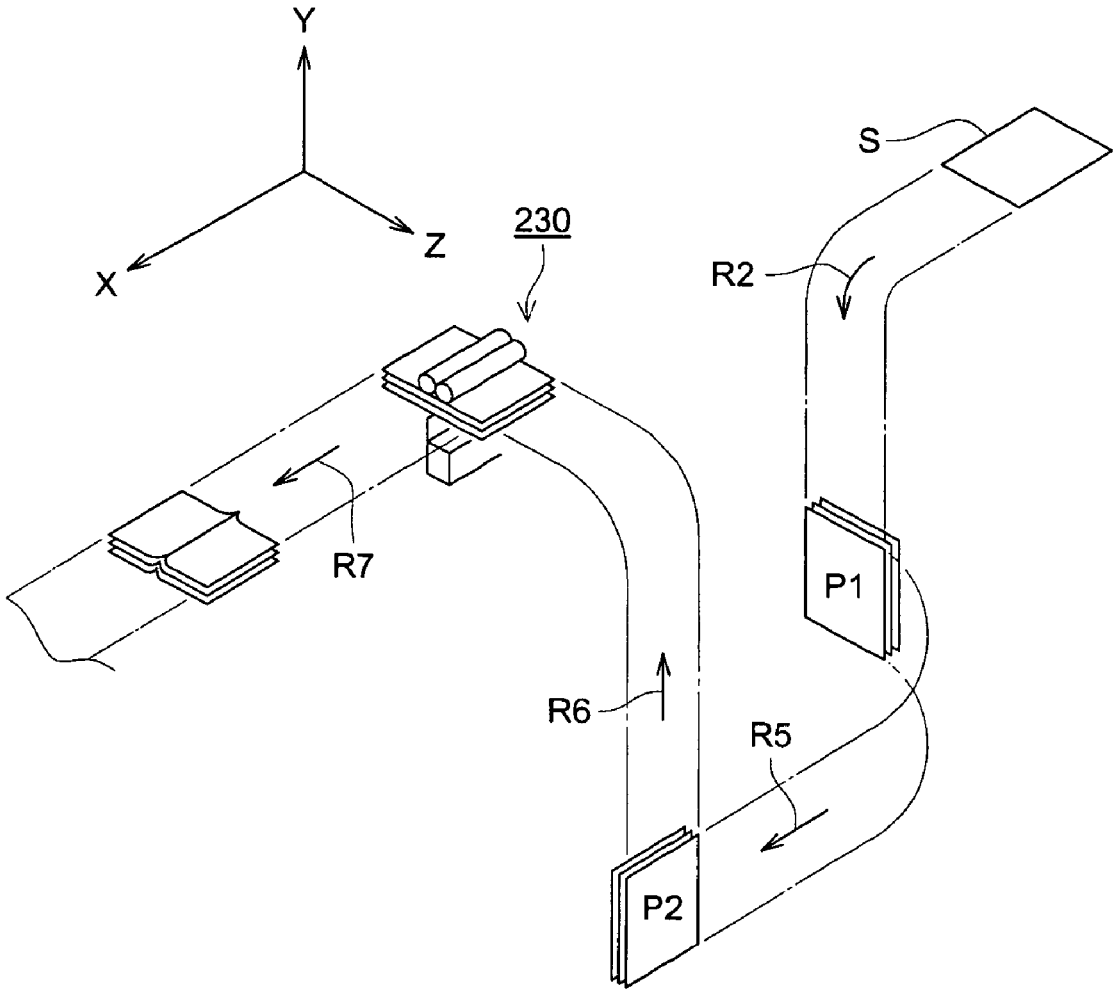
FIG. 5 is a schematic diagram showing a part of sheet flow in a post-processing apparatus.

FIG. 2 is a front view of a post-processing apparatus related to the embodiment of the invention, FIG. 3 is a right side view of it, FIG. 4 is a left side view of it and FIG. 5 is a schematic diagram showing a part of a sheet flow in the post-processing apparatus.

In each of the above-mentioned views, arrows X, Y and Z represent axes of rectangular coordinates indicating directions, and positive directions of coordinates are named X direction, Y direction and Z direction and negative directions are named reverse X direction, reverse Y direction and reverse Z direction respectively.

Regarding the directions perpendicular to the sheet of paper, when the arrow points toward the surface of the sheet, it is described by ⊙, and when the arrow points toward the back of the sheet, it is described by ○.

The sheet of paper S on which an image is formed by an image-forming apparatus is conveyed to either the conveying passage through which the sheet is delivered without being processed or the conveying passage in which center-folding and saddle-stitching are processed on the sheet.

The sheets S fed to the conveying passage for center-folding and saddle-stitching are subjected to center-folding after plural sheets are piled, and then loaded on an inverted V-shaped loading means. After the number of the sheets piled reaches the prescribed one, saddle-stitching is conducted and then the sheets are unloaded by an unloading means and discharged after trimming of the edge by the trimming apparatus related to the embodiment.

Firstly, an explanation will be given regarding a conveying route of sheet S which has entered conveying passage R1 referring to FIG. 2.

Sheet S fed to conveying passage R1 by passage-switching means G1 is pinched and conveyed by conveying rollers 203 through 207 to be fed to either a conveying passage R3 on the upper side of conveying-passage switching means G2 or a conveying passage R4 on the lower side thereof.

The sheet S fed to the upper conveying passage R3 is delivered by paper-discharge roller 208 to the sub-discharge tray (top tray) 209 located on the upper portion of post-processing apparatus B.

The sheet S fed to the lower conveying passage R4 is pinched and conveyed by conveying rollers 210 through 213 and fed to another post-processing apparatus by paper-discharge roller 214.

Next, an explanation will be given regarding conveyance of sheet S which has entered a conveying passage R2, referring to FIG. 2 and FIG. 5.

The sheet S fed to the conveying passage R2 by conveying-passage switching means G1 is conveyed in the reverse Y direction and stays to be stored temporarily at the prescribed position (position P1 indicated in the diagram).

A small amount of subsequent sheets S are piled additionally to be stored at the position P1.

Although the number of stored sheets stated above according to the embodiment is three, the number is not limited to this and can be set properly.

The stored three sheets S at the position P1 are conveyed in the piled state in the Z direction by conveying rollers 215, 216 and guide plates (not illustrated), and then are turned to be deviated in the X direction and stop temporarily at the position P2 (conveying passage R5).

In the following explanation, plural sheets S piled are simply represented by bundle of sheets SS, unless otherwise provided.

The bundle of sheets SS staying at the position P2 temporarily is conveyed in the Y direction according to a prescribed timing by conveying rollers 217, 218 and guide plates, and then is deviated in the reverse Z direction (conveying passage R6).

The bundle of sheets SS deviated in the reverse Z direction is fed to center-folding means 230 by a conveyance-registering belt 220.

Here, an explanation is given regarding the center-folding means 230 referring to FIG. 3.

The means according to the embodiment is structured so that the lengthwise direction of the bundle of sheets SS may agree with the direction of conveyance of the conveyance-registering belt 220.

The center-folding means 230 includes a registering member 232, center-folding rollers 234, 235 and a center-folding knife 236.

The registering plate 232 is located so that the distance between the registering plate and the contacting point of center-folding rollers 234 and 235 is equivalent to a half length of the sheet S in the lengthwise direction of the sheet.

Bundle of sheets SS conveyed in the reverse Z direction is pushed by a registering claw 221 mounted on the conveyance-registering belt 220 and conveyed on a guide plate 251 which composes center-folding sheet conveying means 250, which will be described later, until the bundle of sheets stops at the position where the leading edge of the bundle of sheets SS hits registering member 232.

Subsequently, the registering claw 221 is moved back and forth by a reciprocal rotation of the conveyance-registering belt 220, and the trailing edges of the sheets SS (three sheets) are pressed and the bundle of sheets SS is aligned in terms of width in the direction of the conveyance.

After completion of the aligning operation described above, the center-folding knife 236 mounted at the lower position of the contacting point of center-folding rollers 234 and 235 pushes up the bundle of sheets SS on guide plate 251 at the middle portion in the lengthwise direction of the bundle of sheets SS to make the sheets to be pinched by center-folding rollers 234 and 235 rotating in the directions of arrows shown in the diagram.

After the pinched bundle of sheets SS is given a fold at the middle portion in the lengthwise direction of the sheets by center-folding rollers 234 and 235, the sheets are fed back onto the guide plate 251 by reverse rotation of center-folding rollers 234 and 235 and transported in the direction of X by center-folded sheet conveying means 250 which will be described later.

The means is composed wherein, when the size of the sheet is changed, the position of the registering plate 232 and the operation of the registering belt 220 and so on can be changed according to the size of the sheet by a control means which is not illustrated.

It is also possible to apply Z shaped folding (tri-folding) to sheet S by using the roller 237 and the folding knife 238.

Back to FIGS. 2 and 5, bundle of sheets SS given a fold at the middle portion in the lengthwise direction of the sheets is conveyed in the X direction by conveying the claw 252 fixed on the conveying belt of center-folded sheet conveying means 250 and guide plates which are not illustrated, and loaded on loading means 310 (conveying passage R7).

Next, an explanation will be given regarding loading means 310, stapling means 350 and staple receiving means 370 which constitute saddle-stitching means, referring to FIG. 4.

The loading means 310 includes fold-supporting member 311 which is inverted V-shaped and side edge supporting members 312 which are also inverted V-shaped, and the fold-supporting member 311 supports the vicinity of fold "a" on the valley side (lower side) of the bundle of creased sheets SS and side edge supporting members 312 supports the valley side of side edge portions of the bundle of creased sheets SS.

The valley side surface of bundle of creased sheets SS represents the inner surfaces facing each other when the sheets are folded along the fold and a hill side surface represents the outer surfaces of the sheets.

Holding means 330 which is vertically movable and stapling means 350 which is fixed to the body are placed above the loading means 310.

Staple receiving means 370 which is vertically movable is placed below the fold "a" of the loaded bundle of sheets SS.

A pair of stapling means 350 and a pair of staple receiving means 370 both of which are parts of sheet-stitching means are placed at two positions equally divided on both sides when viewed in the lengthwise direction of the fold.

By means of the structure described above, when the number of the bundle of sheets SS loaded on the loading means 310 reaches the prescribed one, holding means 330 lowers and staple receiving means 370 rises while the holding means is holding the bundle of sheets SS and then staples are shot to two portions on the fold of the sheet S by stapling means 350.

An explanation will be given regarding how to unload saddle-stitched bundle of sheets SS referring to FIG. 2 and FIG. 4.

Unloading means 420 for unloading bundle of sheets SS includes supporting means 421 and a driving means (no reference symbol).

Supporting means 421 includes supporting members 422 and 423 which are located on the both ends of the bundle of sheets SS loaded on the loading means 310 and the supporting members 422 and 423 are structured by bar members having bent parts 422A and 423A respectively where they are bent at right angle at the ends to support a fold part of the bundle of sheets SS.

The other ends of supporting members 422 and 423 are supported rotatably around supporting stem 424.

The supporting members 422 and 423 are structured on right and left in FIG. 2 so that they can be inserted in and parted from the fold part of the bundle of sheets SS in order to support the loaded bundle of sheets SS by the driving means.

The supporting members 422 and 423 are swung by the driving means with supporting stem 424 centered, between the unloading position for the bundle of sheets SS placed on the loading means 310 and the delivering position for the bundle of sheets SS to be delivered to a receiving conveyor 500 as shown in FIG. 4.

By means of this structure, when the number of the bundle of sheets SS loaded on the loading means 310 reaches the prescribed one and saddle-stitching process is completed by saddle-stitching means, the supporting means 422 and 423 are inserted in space near the fold of the loaded sheets, and support the bundle of sheets SS at the fold part, and then, swing from the unloading position to the delivering position so that the bundle of sheets SS is loaded on the receiving conveyor 500 and the loaded bundle of sheets SS is pinched by a grip 501.

The bundle of sheets SS pinched by the grip 501 is conveyed downward obliquely, according to the rotation of the receiving conveyor 500 and delivered to the trimming conveyor 600 after released from the grip 501.

The trimming conveyor 600 is leveled down after the delivery of the bundle of sheets SS, and subsequently, the bundle of sheets SS is conveyed toward trimming means 700 with the fold part being held by a fold-holding member which will be described later and uneven edges (free edge on the opposite side of a fold) are trimmed by a trimming device 700, after the sheets are stopped at the prescribed position.

After the trimming process is completed, the bundle of sheets SS is conveyed in the reverse direction by the trimming conveyor 600 and dropped from the end of the trimming conveyor 600 in the direction of the arrow to be collected by a collecting conveyor 800 and to be discharged to a paper discharge tray 850 located on the outside of the front face of the post-processing apparatus B.

Next, a detailed explanation will be given regarding the trimming apparatus 700, referring to FIG. 6 through FIG. 8.

Firstly, an explanation will be given referring to FIG. 6 regarding a mechanism, wherein center-folded and saddle-stitched bundle of sheets SS is delivered from the receiving conveyor 500 to the trimming conveyor 600 and stopped at the prescribed position after the delivery, for an edge trimming by the trimming apparatus 700.

Figure 6:
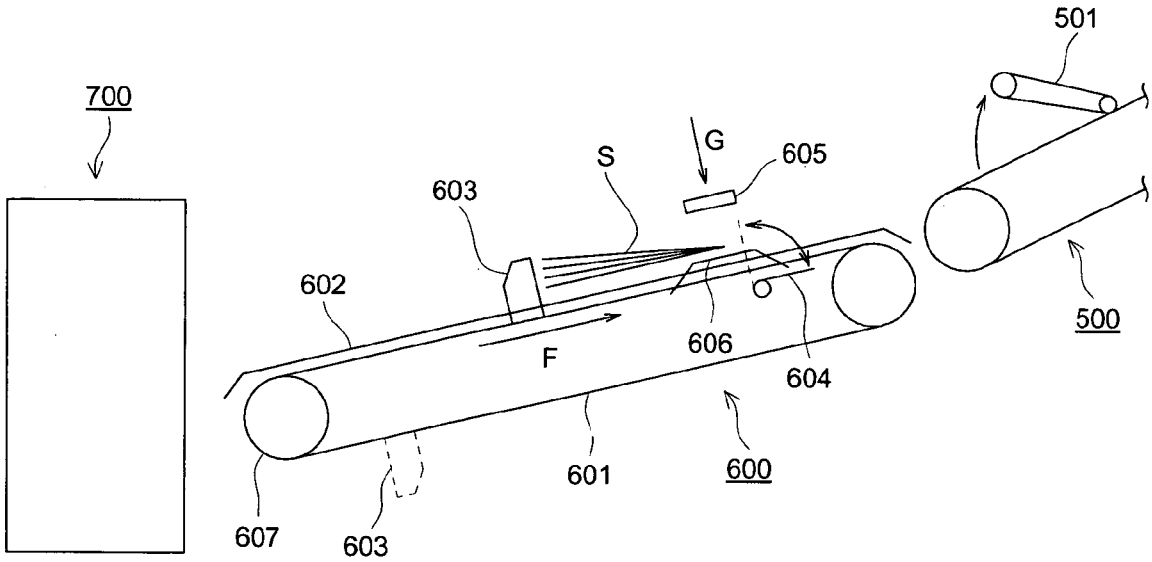
FIG. 6 is a schematic diagram of trimming conveyor 600 and a conveying mechanism of bundle of sheets SS.
Figure 6:
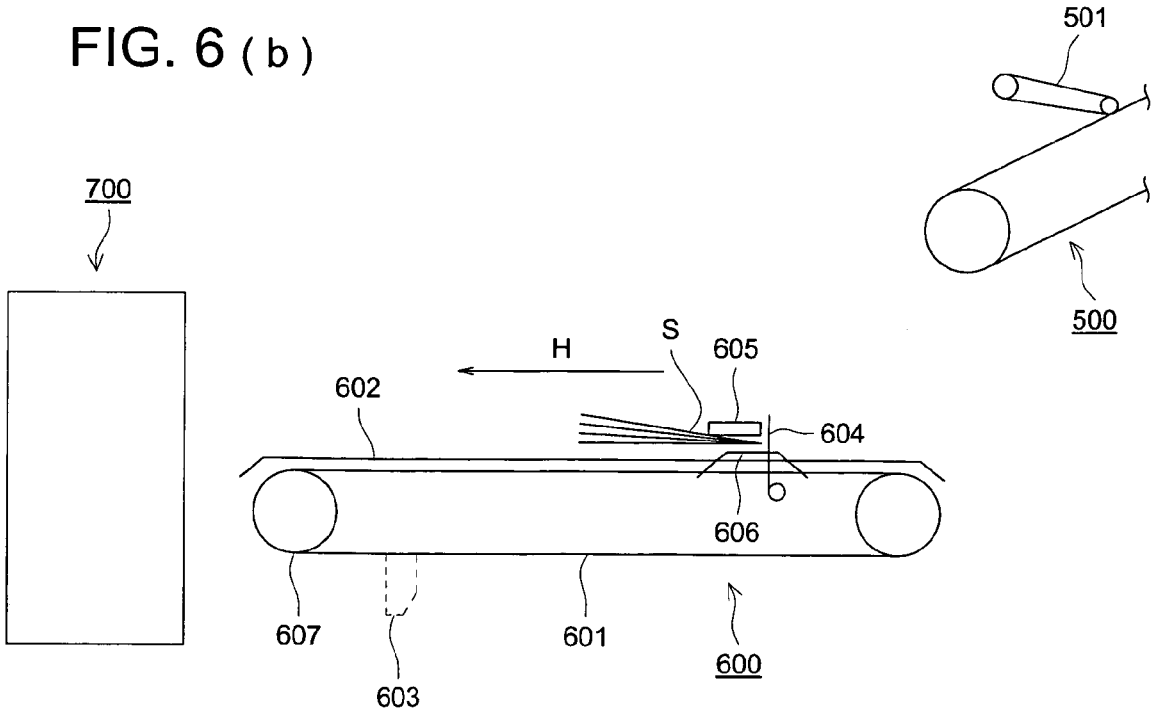

FIG. 6 shows a schematic diagram of the trimming conveyor 600 and a conveying mechanism for bundle of sheets SS.

The Grip 501 opens and releases bundle of sheets SS which was pinched by the grip, near the end of downstream side of the receiving conveyor 500 in the paper conveying direction, as shown in FIG. 6(*a*).

The released bundle of sheets SS slides on a slant surface of a paper loading table 602 provided to be close to and parallel to the upper part of the conveying belt 601 of inclined and stopped trimming conveyor 600, and stops after hitting a stopper claw 603 fixed on the conveying belt 601.

A registering member 604 swings from the position illustrated with a solid line to the position illustrated with a dotted line in the diagram after the bundle of sheets SS stops.

After the registering member 604 swings, the conveying belt 601 moves in the direction indicated by arrow F and stops when the stopper claw 603 makes the fold part of the bundle of sheets SS hit the registering member 604.

In this way, a skew of bundle of sheets SS from the feeding direction is corrected by making the sheets hit the registering member 604.

After the stopper claw 603 stops, a fold-holding member 605 lowers in the direction shown by arrow G in the diagram and pinches the bundle of sheets SS with a backing plate 606 which is mounted to have a plane which is substantially the same as the sheet loading table 602.

After completion of the pinching of the bundle of sheets SS, the trimming conveyor 600 rotates and the stopper claw 603 is retreated to the position illustrated with dotted lines in the diagram.

After completion of the retreat of the stopper claw 603, the registering member 604, the fold-holding member 605 and the backing plate 606 are swung solidly with the trimming conveyor 600, while pinching bundle of sheets SS, around the center of pulley 607 of the trimming conveyor 600, and stopped at the horizontal position indicated in FIG. 6(*b*).

After the swing motion of the trimming conveyor 600 is completed, the bundle of sheets SS is moved in the direction of arrow H shown in the diagram while sliding on the sheet loading table 602, during being pinched by the fold-holding member 605 and the backing plate 606, and the bundle of sheets SS stops at the prescribed position determined according to the size of respective sheets.

The bundle of sheets SS which stops at the prescribed position has the edges trimmed by the trimming apparatus 700, and the trimming mechanism will be explained referring to FIGS. 7-9.

A shaft 708 supported by a frame 700A of the sheet-trimming apparatus is equipped on the upper side of the sheet-trimming apparatus 700. Male screws 708A and 708B which lead the opposite directions to each other are equipped on the shaft 708 and the male screw 708A is engaged with a female screw unit 706 and the male screw 708B is engaged with a female screw unit 707.

A edge holding member 701 which is vertically movable and the female screw units 706 and 707 are connected by links 704 and 705. Specifically, the upper end of the link 704 is supported rotatably to the female screw unit 706 and the lower end is supported rotatably to the left end of the edge holding member 701. Similarly, the upper end of the link 705 is supported rotatably to the female screw unit 707 and the lower end is supported rotatably to the right end of the edge holding member 701. The shaft 708 is connected to a motor 709 via a gear G1 and rotation of the motor 709 shifts the female screw units 706 and 707 horizontally and inclines of the links 704 and 705 change so that the edge-holding member 701 makes a parallel shift vertically.

As mentioned above, the motor 709, the shaft 708, the female screw units 706 and 707, the links 704 and 705 compose a driving mechanism of the edge-holding member 701 so that the edge-holding member 701 may make a parallel shift vertically.

Bundle of sheets SS is retained between a fixed supporting table 702 and a blade receiving member 701A. The edge holding member 701 presses and retains the bundle of the sheets SS with high pressure because it is driven by the driving mechanism with a large speed reduction ratio, including the male screws 708A and 708B.

Rollers 715 and 716 are fixed to a trimming blade 703 having a blade edge structured on its upper end and the rollers 715 and 716 are guided by guiding members 717 and 718 which are inclined toward the lower right. Though the guiding members 717 and 718 are not illustrated, they are fixed to the frame 700A.

A blade-driving member 725 is driven by male screws 726 and 727 to make a parallel shift horizontally. The male screws 726 and 727 are driven by a motor 728 through gears G12-G15. On the other hand, a vertical long hole 725A is provided on the blade-driving member 725, and two pins 719 fixed to a base 703A of the trimming blade 703 are engaged in the long hole 725A.

The motor 728, the gears G12-G15, the male screws 726 and 727 and the blade-driving member 725 compose the blade-driving mechanism of the trimming blade 703 and the trimming blade 703 shifts horizontally by rotation of the motor 728. The trimming blade 703 travels in an oblique direction, which is a composition of a horizontal direction and a vertical direction by guiding members 717 and 718, specifically, in the direction indicated by arrow J. In this way, the trimming blade 703 travels obliquely as indicated by arrow J by drive of the motor 728.

Figure 8:
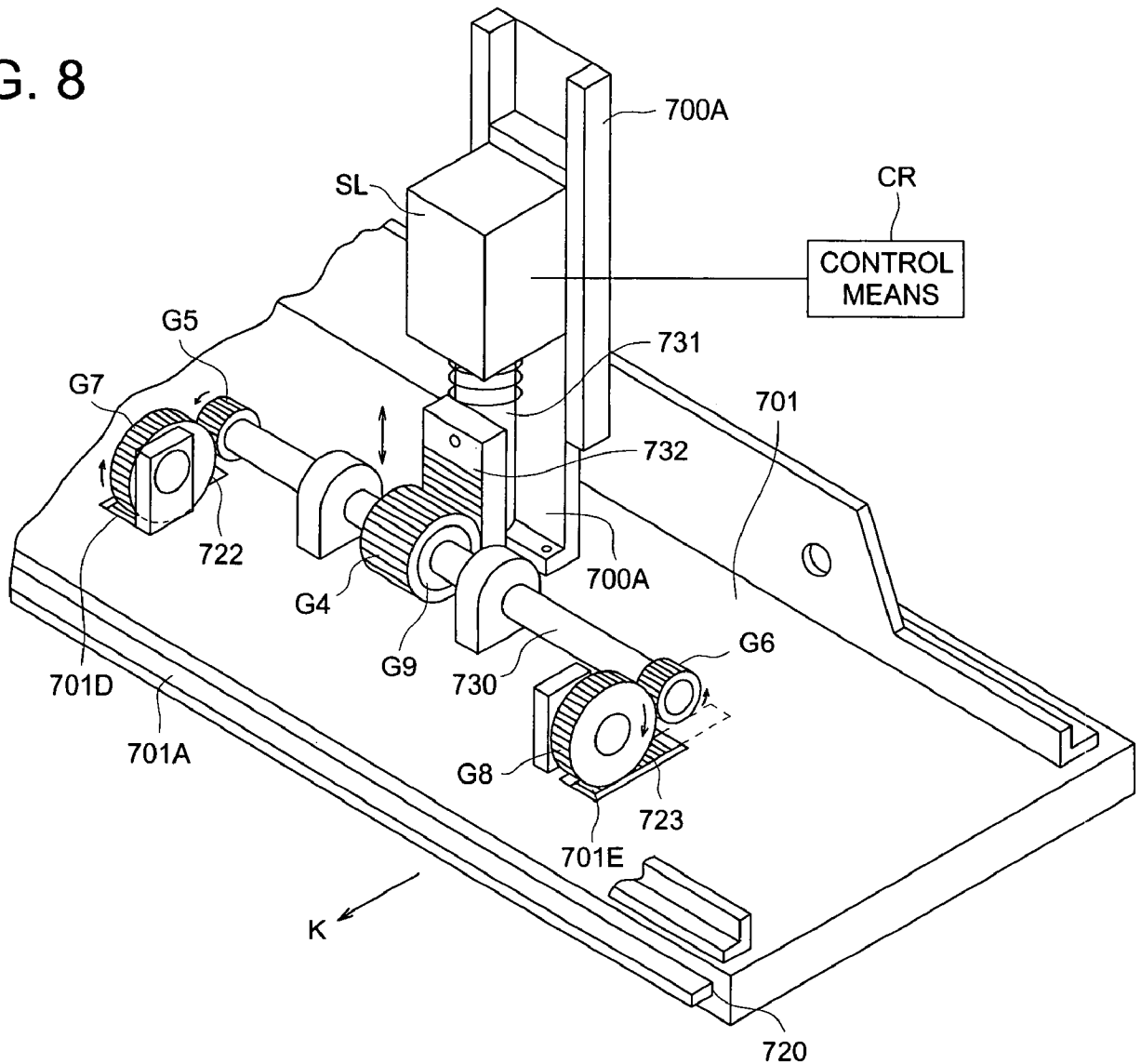
FIG. 8 is a perspective view of a holding member.
Figure 9:
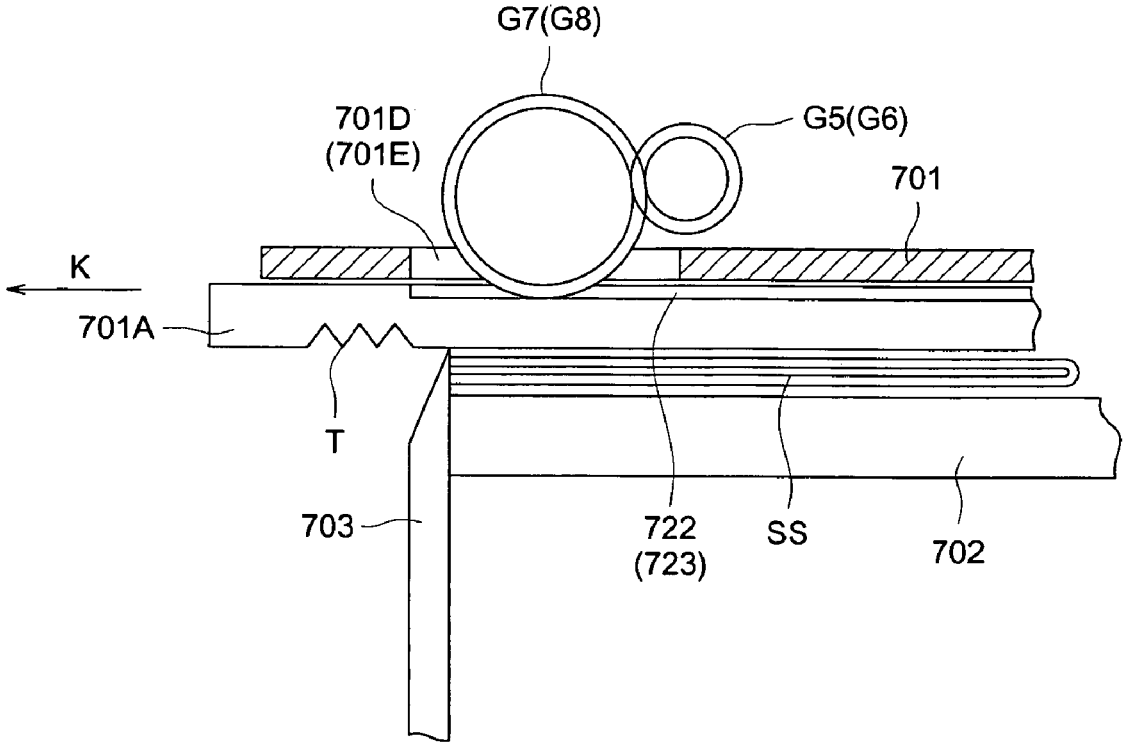
FIG. 9 is an enlarged view of a sheet-trimming portion.

As shown in FIGS. 8 and 9, the lower end of edge holding member 701 is composed by the blade-receiving member 701A and the blade-receiving member 701A is retained on edge holding member 701 by concave parts 720 and is slidable in the direction perpendicular to the lengthwise direction of the trimming blade 703 as shown by arrow K.

Racks 722 and 723 are formed on both end parts of an upper face of the blade-receiving member 701A, and they are exposed above through openings 701D and 701E provided on the edge holding member 701.

Racks 722 and 723 are engaged with pinions G7 and G8 respectively and pinions G7 and G8 are engaged with gears G5 and G6 fixed on both ends of shaft 730 respectively. The shaft 730 is connected with solenoid SL through a one-way clutch G9 and a gear G4. That is, a rack 732 which is fixed to a plunger 731 of the solenoid SL engages with the gear G4 and the shaft 730 is driven by one-way rotation of the gear G4.

Because of operation of the one-way clutch G9, only the rising motion of the plunger 731 made by switch-on of the solenoid SL is transmitted to the gear G4 and the lowering motion of the plunger 731 made by switch-off of the solenoid SL is not transmitted to the gear G4.

The solenoid SL, the rack 732, the one-way clutch G9, the gears G4-G8 and the racks 722 and 723 compose a receiving-member driving mechanism of the blade-receiving member 701A and the blade-receiving member 701A inches in the direction of arrow K by the operation of the solenoid SL.

Next, an explanation will be given regarding an operation of the trimming apparatus 700.

In a stand-by state, the female screw unit 706 is at the left end and the female screw unit 707 is at the right end and the edge holding member 701 is at the upper end.

When bundle of sheets SS is introduced into the trimming apparatus 700, the motor 709 starts and drives the female screw units 706 and 707 to lower the edge holding member 701. At the position where the edge-holding member 701 is detected by detecting means PS, the motor 709 stops and the edge holding member 701 stops. The stopping position of the edge holding member is determined by the positioning of the detecting means PS, and the position of the detecting means PS is determined by the number of sheets constituting bundle of sheets SS. Accordingly, the descending position of edge holding member 701 is set at the controlling portion of the image-forming system according to the number of sheets constituting the predetermined bundle of sheets SS.

The edge holding member 701 holds bundle of sheets SS with big pressure so that the sheets do not slide even when a large pile of sheets are given horizontal force by the trimming blade 703 in the course of trimming operation, which will be explained later.

When a holding motion on bundle of sheets SS is completed, the motor 728 starts and shifts the trimming blade 703 to the upper left in the direction indicated by arrow J. By this shift of the trimming blade 703, the bundle of sheets SS is trimmed. Because the trimming operation of the trimming blade 703 is a trimming by a slide of a blade, a trimming by relatively small driving force is possible and even when the number of sheets to be trimmed increases, only the stroke of the trimming blade changes and the driving force remains unchanged.

After trimming of all the sheets loaded, the edge of trimming blade 703 contacts the blade-receiving member 701A and the driving force of the trimming blade 703 increases. The motor 709 is stopped when this increase of driving force, namely, increase of a motor driving current caused by increase of a load of the motor 709 is detected. As described above, all the sheets composing bundle of sheets SS are trimmed.

Figure 7:
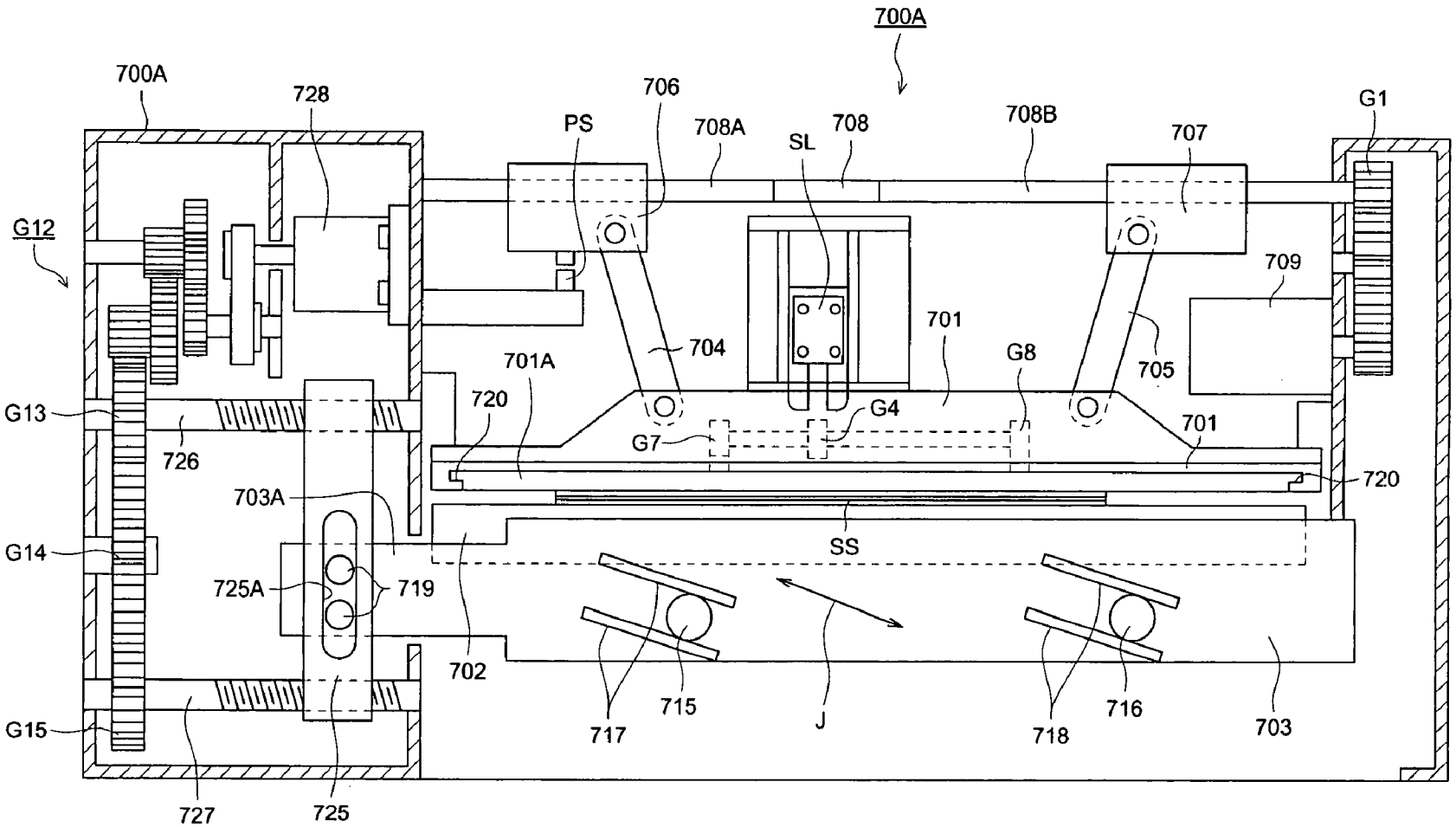
FIG. 7 is a front view of sheet trimming apparatus 700 related to the embodiment of the invention.

After completion of an edge trimming, the lower-blade driving motor 728 rotates reversely and the lower blade 703 lowers obliquely to the prescribed position at the lower right in FIG. 7.

After completion of the lowering motion of the lower blade 703, the edge holding-member 701 rises to the original position.

After completion of the rising motion of the edge holding member 701, when the fold-holding member 605 and the backing plate 606 which have held the vicinity of the fold of the bundle of sheets SS return to the position indicated in FIG. 6(*b*), the fold-holding member 605 rises and the aligning member 604 is retreated downward under the sheet conveying plane and the bundle of sheets SS is released from the pinch.

Next, the trimming conveyor 600 rotates, and the bundle of sheets SS, the edge of which has been trimmed, is dropped by the stopper claw 603 in the direction indicated by the arrow from the end of the trimming conveyor 600 and conveyed by rotating of the collecting conveyor 800, and then, discharged into the paper discharge tray 850 arranged on the front side of the post-processing apparatus B as shown in FIG. 4.

With the series of motion stated above, an edge trimming process for bundle of sheets SS is completed.

By the repetition of the trimming operation, a part of the blade-receiving member 701A is chopped off and removed by the trimming blade 703 even though an amount of the removal is very small, and it results in formation of notch T on the blade-receiving member 701A as shown in FIG. 9. When the depth of the notch T becomes large, there is a case where defective operations occur such as an incomplete cut of sheets and unevenness of the trimmed edge surface.

In this embodiment, as explained above, the blade-receiving member 701A is shifted in the direction K perpendicular to the lengthwise direction of the trimming blade 703 to place an unused portion of the blade-receiving member 701A to the position where the edge of the trimming blade 703 contacts. By means of the operation of the solenoid SL, the receiving-member driving mechanism, which was explained above, works to inch blade-receiving member 701A in the direction K.

By means of this, the depth of the notch can be limited and trimming defects caused by the notch do not occur even though plural notches T are formed as shown in FIG. 9.

A controller CR in FIG. 8 counts the number of trimming motions and when the counted number reaches the prescribed one, for example, 700 times, it operates the solenoid SL and shifts the blade-receiving member 701A.

In the example of the embodiment, there is realized a sheet-trimming apparatus which can provide a trimming work with a good finish regardless of the number of the sheets, and can work with small power and is compact. It is also possible to prevent a defective trimming such as an incomplete cut and an uneven trimmed surface because an unused portion of the blade receiving member sustaining sheets is provided periodically and the depth of notches formed on the blade receiving member by the trimming blade is always maintained within the allowable range.

In the example of the embodiment, a good performance of trimming can be maintained for a long time because an unused portion of the blade-receiving member is automatically supplied.

In the example of the embodiment, there is realized a compact sheet post-processing apparatus which can produce booklets of various kinds of thickness containing various numbers of sheets from a small number to a large number.

In the example of the embodiment, there is realized a compact image-forming system which can produce booklets of various kinds of thickness containing various numbers of sheets from a small number to a large number.

This invention has been described above with reference to the aforementioned embodiments. It is evident, however, that many alternative modifications and variations will be foregoing description. Accordingly, the present invention embraces all such alternative modifications and variations as fall within the spirit and scope of the appended claims.

What is claimed is:

1. A sheet-trimming apparatus for trimming a sheet located in a trimming position, the sheet-trimming apparatus comprising:

a trimming blade to trim a sheet which has been substantially horizontally located in the trimming position;

a blade-driving mechanism structured to bring said trimming blade into contact with said sheet from under a surface of said sheet and to move said trimming blade in a trimming direction to trim said sheet located in said trimming position;

a blade-receiving member to receive said trimming blade on an upper surface of said sheet, said blade-receiving member being formed into a plate and being positioned at a first position such that said trimming blade contacts said blade-receiving member at a first portion of said blade receiving member;

a blade receiving-member driving mechanism structured to shift said blade-receiving member relative to said trimming blade so that said blade-receiving member can be positioned at a second position such that said trimming blade contacts said blade-receiving member at a second portion of said blade receiving member; and a sheet-holding member traveling between a working position where said sheet-holding member holds said sheet at the trimming position and a retreated position;

wherein said blade-receiving member is structured to be movable relatively with said sheet holding member by said blade-receiving member driving mechanism; and wherein a part of the sheet-holding member is composed of the blade-receiving member.

2. The sheet-trimming apparatus of claim 1, wherein said blade-receiving member driving mechanism shifts said blade-receiving member in only one direction cross to said trimming direction of the trimming blade.

3. The sheet-trimming apparatus of claim 1, further comprising:

a holding-member driving mechanism which moves said sheet-holding member between said working position and said retreated position.

4. The sheet-trimming apparatus of claim 1, further comprising:

a controller to operate the blade-receiving member driving mechanism to shift the blade-receiving member after each group of trimming operations of a prescribed number.

5. The sheet-trimming apparatus of claim 1, wherein the trimming direction of the trimming blade is oblique to a surface of the sheet.

6. The sheet-trimming apparatus of claim 1, wherein said blade-receiving member driving mechanism shifis said blade-receiving member along a surface of the plate of the blade-receiving member.

7. The sheet-trimming apparatus of claim 1, wherein a part of the blade-receiving member is formed of a rack, and the blade receiving-member driving mechanism shifis said blade-receiving member by rotating a pinion which engages with the rack.

* * * * *